US006029896A

United States Patent [19]

Self et al.

[11] Patent Number: 6,029,896

[45] Date of Patent: Feb. 29, 2000

[54] METHOD OF DROP SIZE MODULATION WITH EXTENDED TRANSITION TIME WAVEFORM

[75] Inventors: Roger G. Self, Garland; David B. Wallace, Dallas, both of Tex.

[73] Assignee: MicroFab Technologies, Inc., Plano, Tex.

[21] Appl. No.: 08/940,731

[22] Filed: Sep. 30, 1997

[51] Int. Cl.[7] ..... B05B 17/06

[52] U.S. Cl. ..... 239/4; 347/11

[58] Field of Search ..... 347/11, 1; 239/4, 239/102.2

[56] References Cited

U.S. PATENT DOCUMENTS

| | | | |
|---|---|---|---|
| 3,857,049 | 12/1974 | Zoltan | 310/8.1 |
| 4,418,354 | 11/1983 | Perduijn | 346/140 R |
| 4,584,590 | 4/1986 | Fischbeck et al. | 346/140 R |
| 4,825,227 | 4/1989 | Fischbeck et al. | 346/1.1 |
| 4,887,100 | 12/1989 | Michaelis et al. | 346/140 R |
| 5,053,100 | 10/1991 | Hayes et al. | 156/294 |
| 5,229,016 | 7/1993 | Hayes et al. | 222/590 |
| 5,365,645 | 11/1994 | Walker et al. | 29/25.35 |
| 5,400,064 | 3/1995 | Pies et al. | 347/68 |
| 5,415,679 | 5/1995 | Wallace | 75/331 |
| 5,426,455 | 6/1995 | Williamson et al. | 374/10 |
| 5,436,648 | 7/1995 | Stortz et al. | 347/10 |
| 5,444,467 | 8/1995 | Stortz | 347/12 |
| 5,461,403 | 10/1995 | Wallace et al. | 347/10 |
| 5,643,353 | 7/1997 | Wallace et al. | 75/331 |

*Primary Examiner*—Lesley D. Morris
*Attorney, Agent, or Firm*—Locke Liddell & Sapp LLP

[57] ABSTRACT

The present invention uses a novel waveform to allow the droplet volume dispensed from a demand mode inkjet type device to be increased and selected according to easily controllable parameters. The current invention departs from the conventional drive method by significantly increasing the time for energy input in the initial instance as well is in all later application of the drive voltage to the device. In shape, the waveform is the same whether a unipolar or bipolar pulse is utilized; however, the transition times in the initial instance are up to three times the acoustic resonance and the delay times are of the same order. Droplet diameter can be varied from 1X the orifice diameter to 2X the orifice diameter resulting in an 8:1 range of droplet volume. Since the volume modulation results from changes in the waveform used to drive the solder jet device, the drop volume can be changed and altered in real time.

31 Claims, 7 Drawing Sheets

Droplet size modulation via extended transition waveform

METHOD OF DROP SIZE MODULATION WITH EXTENDED TRANSITION TIME WAVEFORM

BACKGROUND OF THE INVENTION

1. Field of the Invention

The invention relates to increasing the size of microdrops produced by ink-jet technology to a size which is significantly larger than the orifice diameter; especially solder microdrops for use in the electronic industry.

2. Background of the Art

Although this invention is applicable to the dispensing of various liquids, it has been found particularly useful in the environment of dispensing very small solder balls to very small soldering areas. Therefore, without limiting the applicability of the invention to "dispensing very small solder balls to very small soldering areas," the invention will be described with reference to that environment.

In a high density electronic manufacturing process, semiconductor integrated circuit chips are bonded to a substrate by a solder reflow process. This is commonly referred to as a "flip-chip" process in which solder bumps are placed on pads of the integrated circuit chip or other chip, then turned over and matched with solder wettable terminals or connect pads or bond pads with or without solder, on a substrate. Such processes are described in U.S. Pat. No. 5,229,016, U.S. Pat. No. 5,193,738, U.S. Pat. No. 5,415,679, and U.S. Pat. No. 5,643,353, all incorporated herein by reference. These references discuss various ways of producing solder bumps and interconnections for electronic devices.

Current flip-chip assembly processes typically use 100–125 $\mu$m diameter bumps on pads of similar dimensions. Solder droplets produced by known solder jet systems are typically 25–75 $\mu$m in diameter with the actual value being largely determined by the orifice diameter of the solder jet device in use. Larger diameter solder bumps are needed. Attempts to operate solder jet devices with orifice diameters greater than 75 $\mu$m to make larger drops have been unsuccessful due to instability of the drop formation process. In addition, it would be highly desirable to be able to select in real-time solder droplet diameter, over a fairly broad range, to be dispensed from a given solder jet device such as mentioned in the patents set forth above.

One approach to producing solder bumps of the larger diameter needed for microelectronic fabrication is to dispense multiple droplets onto a single substrate site in order to overcome the 75 $\mu$m limitation. This has actually been done in private experiments whereby eight or more nominally 50 $\mu$m diameter droplets have been printed onto an integrated circuit pad 125 $\mu$m in diameter where they are solidified in a tower-like mass approximately the same diameter as the pad. Although the drop-to-drop rate in these experiments was fairly high (248 Hz), because of the requirement that the drop impact onto the same location, the printhead had to be stationary during dispensing, and only three to four bumps per second were produced. This is far less than the production rate required to provide economical production. Thus, multidroplet dispensing to a site inherently limits the throughput of a printhead system. To maximize throughput, a single droplet must be dispensed per pad, large enough and allowing the printhead to dispense while it is moving.

In the field of ink-jet technology, attempts have been made to modulate the drop size produced by drop-on-demand type ink-jet printheads in order to improve the image quality.

Such a procedure is disclosed in U.S. Pat. No. 5,461,403 which is incorporated herein by reference. Thus, disclosure illustrates the way a conventional unipolar pulse waveform is applied to the piezoelectric material in an ink-jet device. The voltage in a unipolar pulse rises rapidly from an initial voltage to a first voltage where it is held for a primary dwell time and then rapidly returned to the initial voltage. It illustrates that conventionally, drop volume can be increased to a maximum by varying the primary dwell time, however, velocity of the droplets follows almost exactly the volume curve. Thus any attempt to modulate the size of droplets is cursed with a corresponding change in drop velocity. As a result, droplet placement accuracy is lowered significantly before the droplet volume is significantly decreased. Without droplet placement accuracy, it is said the usefulness of such technology in the printing arts is minimal.

The invention disclosed in the reference is a method of modulating drop size by varying the first and second dwell time in a bipolar waveform. The voltage increases from an initial rest voltage to a first rest voltage. After the primary dwell time, the voltage traverses past the initial rest voltage in an "echo portion" to a second rest voltage is held for an echo dwell time before it is returned to the initial rest voltage. Primarily by adjusting the amount of echo dwell time the references shows it is possible to partially separate the change in volume from the resulting velocity of the droplets as a form of real-time droplet volume modulation. However, these efforts are directed to producing droplets smaller than the orifice diameter in a demand mode ink-jet printing device for image production quality improvements. The initial transition time in the voltage rise from initial rest voltage to the first rest voltage remains conventional at about 1 to 5 microseconds. There is no incentive for conventional ink-jet technology to increase the length of waveform in an ink-jet for printing because it could decrease the operating frequency of the device. Decreased operating frequency would affect the rate at which printing can be done.

SUMMARY OF THE INVENTION

The present invention uses a novel waveform to allow the droplet volume dispensed from a demand mode ink-jet type device to be increased and selected according to easily controllable parameters. The current invention departs from the conventional drive method described above by significantly increasing the time for energy input in the initial instance as well as in all later application of the drive voltage to the device. In shape, the waveform is the same whether a unipolar or bipolar pulse is utilized; however, the transition times in the initial instance are up to three times the acoustic resonant period and the delay times are of the same order. Droplet diameter can be varied from 1X the orifice diameter to 2X the orifice diameter resulting in an 8:1 range of droplet volume. Since the volume modulation results from changes in the waveform used to drive the solder jet device, the drop volume can be changed and altered in real time.

DETAILED DESCRIPTION OF INVENTION

Figure 1:
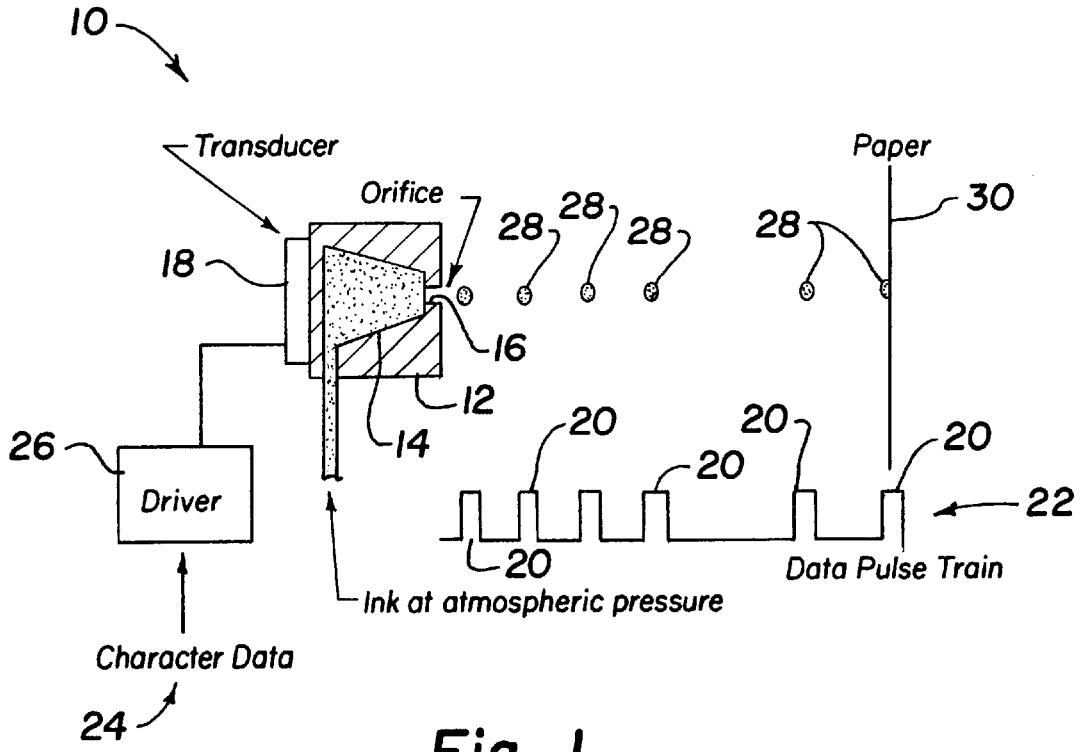
Fig. 1 PRIOR ART
FIG. 1 is a schematic representation of a drop-on-demand ink-jet printing system in which individual microdroplets are produced and directed toward a substrate.

A drop-on-demand ink-jet printing system is schematically illustrated in FIG. 1. These are commonly known as demand mode ink-jet printing systems because they produce a microdroplet in response to a pulsed waveform as opposed to a continuous stream which is broken into droplets in a continuous mode system. In FIG. 1 demand mode system 10 is illustrated as having a printhead 12 containing an ink reservoir 14 with an ink supply and an outlet orifice 16. A transducer 18 is most commonly a piezoelectric material which is directly or indirectly coupled with the fluid in reservoir 14. A volumetric change in the fluid is induced by application of a voltage pulse 20 which may be part of a data pulse train generally indicated by the reference numeral 22. Character data 24 is delivered through an electronic control system comprising driver 26 which delivers a series of individual voltage pulses 20 through transducer 18. This volumetric change causes pressure/velocity transients to occur in the fluid and these are directed so as to produce a series of drops 28 which are ejected at a given velocity toward a substrate 30, which is usually paper as indicated. Such systems are well known and have been adapted to operate at elevated temperatures with molten solder.

Figure 2:
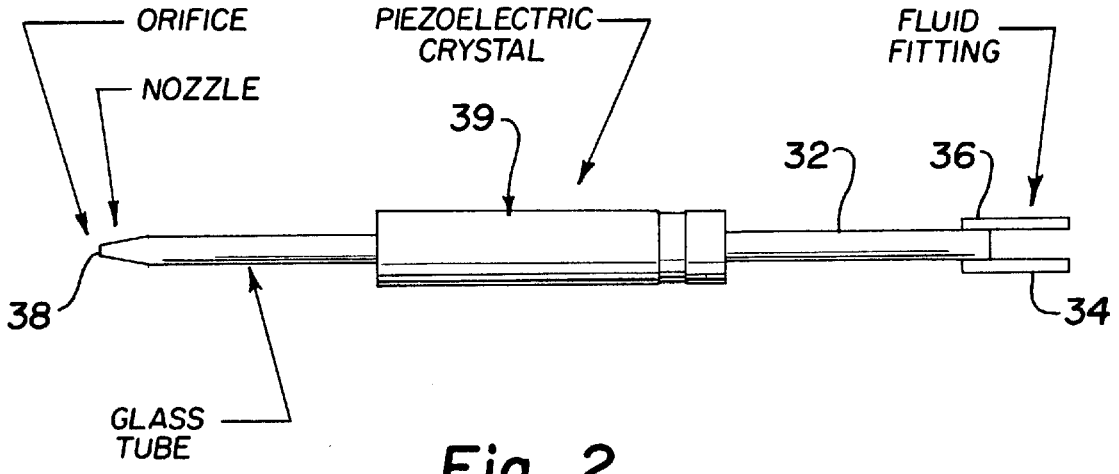
Fig. 2 PRIOR ART
FIG. 2 is a schematic representation of a drop-on-demand ink-jet jetting device configuration.

A drop-on-demand ink-jet device configuration is schematically illustrated in FIG. 2 as an elongated tube 32 having a fluid fitting 34 at one end connected to a source of ink or melted solder with a nozzle having a very fine orifice 38 at the opposite end and made of glass or stainless steel. Piezoelectric crystal 39 comprises a transducer having electrical leads (not shown) connected to a electronic driver and control system such as is illustrated in U.S. patent application Ser. No. 08/581273 filed Dec. 29, 1995 which discloses a printhead for liquid metals and method of use, and identifies a number of other patents which illustrate adaptation of ink-jet technology for dispensing melted solder. This patent is hereby incorporated by reference. A known drive waveform is schematically illustrated in FIG. 3.

Figure 3:
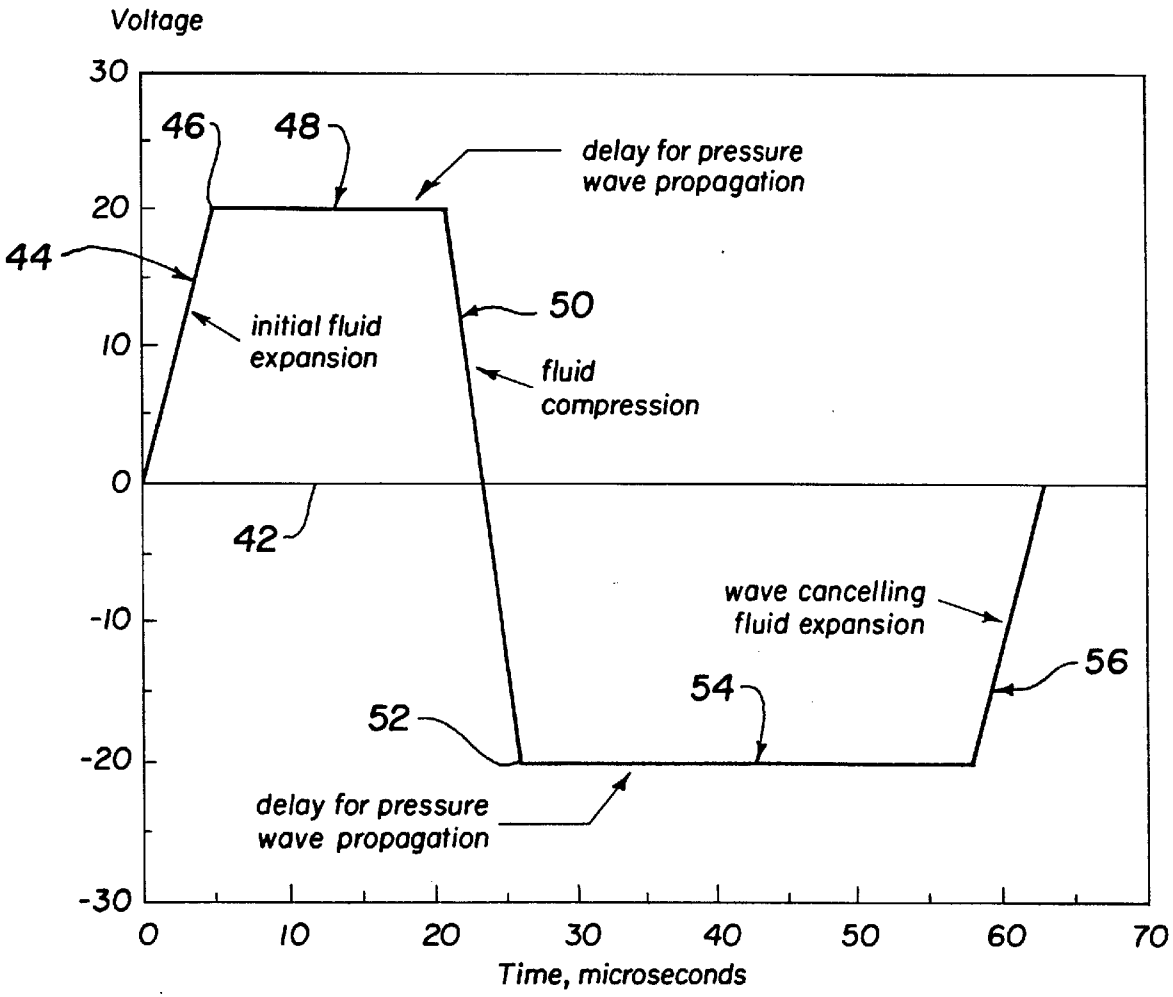
Fig. 3 PRIOR ART
FIG. 3 is a representation of the electronic drive waveform of a known kind for a piezoelectric demand mode ink-jet device of the type shown in the previous Figures.

Referring now to FIG. 3, a known drive waveform is generally referred to by the reference numeral 40. This waveform is applied to piezoelectric devices like those shown in the previous Figures. Voltage is applied from an initial base or initial rest voltage which may or may not be zero. The magnitude of the drive voltage is increased over an initial rise time 44 to a first rest voltage 46 where voltage is held constant for a first dwell time 48. The initial rise time is called the first transition time; transition time meaning the time over which the magnitude of the voltage is increased or decreased from one rest voltage to the next rest voltage. Here the first transition time is the time over which the voltage goes from initial base voltage 42 to voltage 46. For conventional operation, the piezoelectric transducer inputs energy over a 1–5 microsecond period of time. About five microseconds is shown in FIG. 3 traversing the range from 0 to 20 volts. This is a rate of 4 volts/ms. The piezoelectric transducer is poled so that it expands such that a negative pressure is created in the fluid. Thus the initial voltage rise is labeled "initial fluid expansion." To the fluid in the device, this represents an infinitely fast energy input where the resonant fluid acoustic frequency is 15–25 Khz for a device like FIG. 2 of about 25 mm total length. Much of the inkjet technology uses only a unipolar pulse which is that portion of the voltage/time curve above the base line. With a unipolar pulse, after the first dwell time 48 the voltage is simply returned to the base voltage over a second transition time similar to the first transition time.

It is believed that the acoustic energy imparted to the fluid by this initial rise propagates through the device as pressure waves, both towards the orifice and towards the supply end which is the fluid fitting 36 in FIG. 2. These pressure waves reflect off the acoustic boundaries defined by the orifice 38 and fluid fitting 36 and are inverted in magnitude (i.e., the negative pressure waves become positive pressure waves). The pressure waves are thus redirected back towards the center of the device where the piezoelectric electric transducer resides. For a nominally 25 mm long device with a centered piezoelectric transducer, (FIG. 2) the time for the now reflected wave to arrive back under the transducer as a positive pressure wave is approximately 20 microseconds. If the voltage is returned to the initial rest state (whether this voltage is ground or not) at this time, the positive pressure waves will be reinforced as the transducer contracts. The return to the rest voltage (zero) is the second voltage transition labeled "fluid compression." The reinforced positive pressure wave then propagates to the orifice to form a droplet.

A variant of this process is actually what is shown in FIG. 3 whereby the second transition time 50 returns the voltage to the rest value and continues on until it reaches a second rest voltage 52 which is a negative value roughly equal to the positive voltage 46. The additional kick provided by the greater voltage difference between voltage 46 and voltage 52 increases the energy imparted to the fluid, thus increasing droplet velocity and volume. At the second transition 50 may be referred to as the "fall" to voltage 52 which is followed by a second dwell time 54 where voltage is again held constant. At the end of the second dwell time 54 the applied voltage is returned to the initial rest voltage over a third transition time 56. This third transition time may be referred to as the final rise 56. The second dwell time can be varied for several functions, one of which is the drop volume modulation method described in U.S. Pat. No. 5,461,403 mentioned earlier. The full waveform shown in FIG. 3 is referred to as a bipolar waveform.

Each jetting device like that of FIG. 2 has a characteristic acoustic frequency which depends upon the geometry of the device and the physical characteristics of the material from which it is made much like an organ pipe. The acoustic period is the reciprocal of the characteristic frequency that may be defined as the time it takes for one complete cycle of the acoustic wave. The acoustic period being referred to herein is the period determined for an elongated pipe (organ pipe) with both ends open. Methods of calculating or determining the acoustic period of such a structure are well known. There are known formulas to calculate and model the acoustic period characteristic frequencies of jetting devices. A description of the conventional wave phenomena is described in incorporated U.S. Pat. No. 5,461,403. The fundamental physical effect seem to be the same whether the fluid is air, water or solder, except that the wave speed varies in different fluids.

Of particular interest are solder compositions which are jetted at temperatures above their melting points. Attempts were made to create solder droplets of a common eutectic solder melting at about 183° C. from a print head operating at about 200–210° C. It is known that an increase in voltage will produce droplets of greater volume with more velocity. An increase in voltage with a conventional waveform like that of FIG. 3 would produce an increase in diameter of possibly up to 10% greater than the orifice diameter with solder before generating an unstable operating condition which resulted in a failure of jetting altogether or erratic performance coupled with satellite generation which is totally unacceptable for producing and directing microdroplets toward a substrate pad. Attempts to vary the first and second dwell times 48, 54 were equally unsuccessful. Despite operating at a significantly lower frequency than conventional ink-jet conditions (200 Hz vs. 4–8 Khz) and controlling the velocity of the droplets within the range of about 1½ to 2 or possibly up to as much as 3 meters per second, stable operation could not be established.

Figure 4:
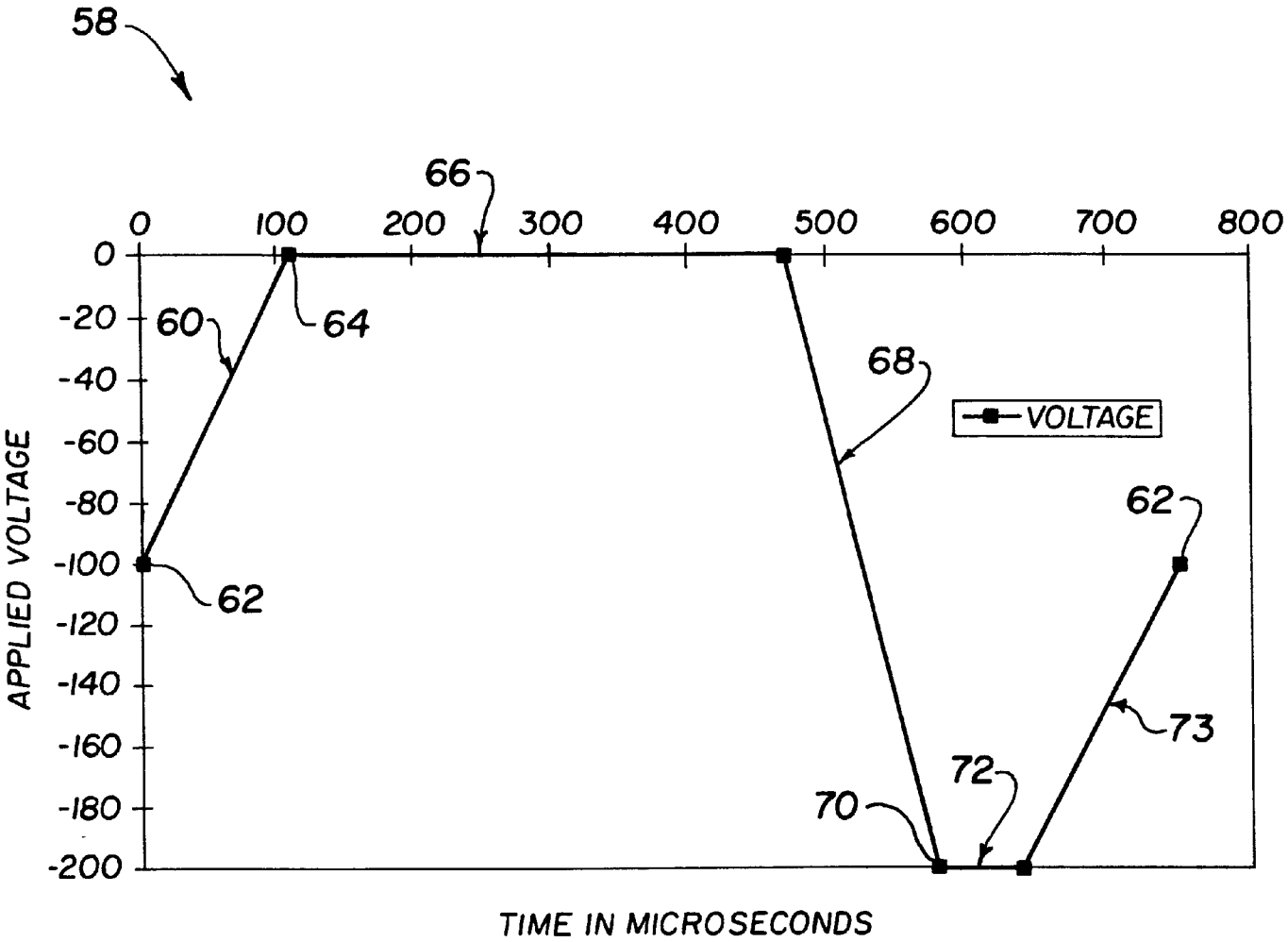
FIG. 4 is a representation of the improved electronic drive waveform of the invention showing substantially extended transition times during which the drive voltage is applied as compared to the transition times of FIG. 3.

During the course of these investigations it was quite surprisingly discovered that if the time over which the voltage transition occurred was very substantially increased it was possible to greatly increase the measured size of droplets produced from the jetting device within the desired velocity range of about 1½–3 meters per second. This was quite different than what would be expected and surprising not only because the drops were bigger but because the operation was stable and reproducible producing consistent uniform drops in demand mode. FIG. 4 illustrates the inventive waveform as a bipolar pulse. Characteristic of the improvement is the greatly expanded time, especially the first transition time, over which the voltage is applied to the jetting device transducer. The first transition time in FIG. 4 is approximately 110 microseconds as compared with typical values of 1–5 microseconds in FIG. 3. This represents a rate of 1.1 volts/ms.

The inventive waveform of FIG. 4 is referred to generally by reference numeral 58. In this case the base voltage is a negative bias voltage used to prevent deposing of piezoelectric material at elevated temperatures during solder jetting as described in U.S. Pat. No. No. 5,643,353 issued Jul. 1, 1997 which is incorporated herein by reference. In the case of FIG. 4 the initial rise time 60 comprising the first transition rises from a negative initial rest voltage 62 to a first rest voltage 64 which is held for a first dwell time 66. After dwell time 66 has expired, the voltage passes through a second transition time or fall 68 to a second rest voltage 70. It is held at constant voltage for a second dwell time 72, after which the third transition time 73 is applied raising the voltage from second rest voltage 70 back to initial rest voltage 62 to complete one pulse. Each of the first, second and third transitions 60, 68 and 73 transpire over the same significantly longer time period (110 microseconds) as compared to the transitions in FIG. 3 (5 microseconds). The inventive waveform of FIG. 4 can take the form of a unipolar pulse. In that case the initial voltage rise and first transition time would be the same except that the voltage difference between the initial rest voltage and the first rest voltage might be greater in order to reach the desired velocity. The unipolar wave would fall only back to the initial rest voltage over a second transition time about the same as the first transition time.

In shape, the waveform of the invention in FIG. 4 follows the pattern of the known waveform of FIG. 3 whether a unipolar or bipolar pulse is utilized, however the transition times are up to three times the acoustic resonant period in FIG. 4 and the delay times are of the same order. The waveform of FIG. 4 was operated at about a 200 Hz with about a 58 micrometer orifice producing about a 90 micrometer diameter solder drop. The first, second and third transition times are each about 110 microseconds, the first dwell time 60 was approximately 360 microseconds and the second dwell time 72 about 60 microseconds.

Figure 7:
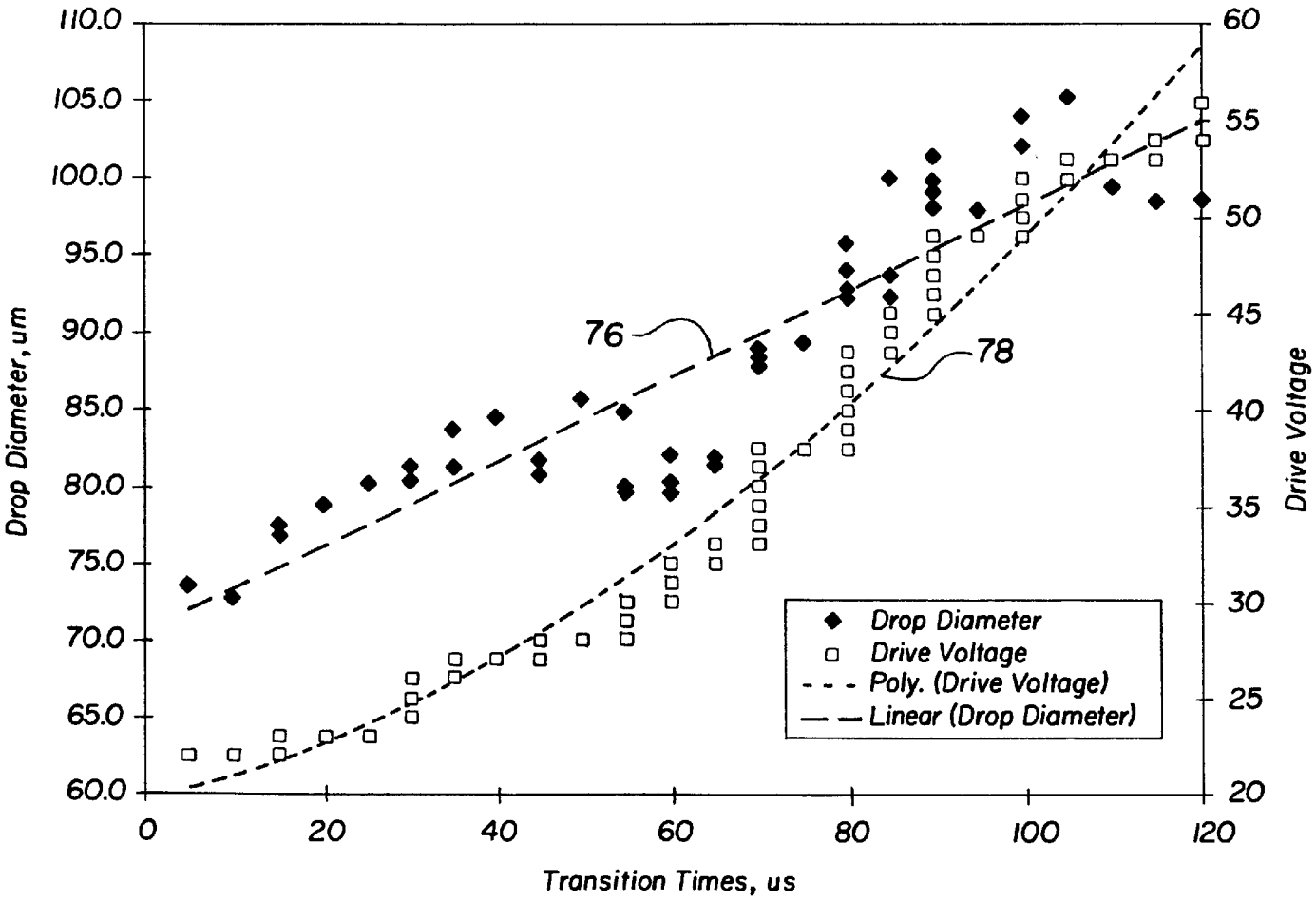
FIG. 7 is a plot of a series of experiments with the device shown in FIGS. 5 and 6 adjusted to roughly constant drop velocity showing how drop diameter, in micrometers from about a 58 micrometer orifice, is increased as the transition time and drive voltage increase, to approximately twice the diameter of the jetting orifice.

FIG. 7 shows how drop size is modulated using an extended transition waveform similar to that of FIG. 4. This data was collected using molten solder in a jetting device having a resonant frequency of less than about 20 Khz. The data were acquired using a 200 Hz drive frequency with a first dwell time 66 of 260 microseconds and a second dwell 72 of 60 microseconds. A continuous variation in drop size from 70 micrometers to 105 micrometers was obtained. The velocity of the droplets produced was controlled to about approximately one meter per second in FIG. 7. Because the extension of the transition time disburses the energy over a longer period of time and a higher volume of fluid, higher drive voltages were required. The drive voltage here is the voltage difference between the initial rest voltage and the first rest voltage. Although the length of the waveform (in time) decreases the maximum operating frequency significantly, which could be a severe limitation for conventional ink-jet printing (i.e., ink on paper), but is not generally a draw back for materials deposition applications of ink-jet printing technology, such as solder deposition on integrated circuits or deposition of other unusual fluids or compositions. The drop diameter is plotted on the linear dotted line 76 in FIG. 7. The drive voltage applied is fitted to a polynomial curve 78 to illustrate the relationship. Drop diameters are determined by accumulating and weighing solidified solder balls produced. Since the density and number of balls collected are known, the average drop diameter can be calculated. When stable conditions are established, each drop is like the previous drop with 10% or less variation in diameter between drops.

Returning now to FIGS. 5 and 6 we have a magnified representation of what the drops actually look like as they are being produced by the jetting device. Each of the figures has superimposed side-by-side representation of the same jetting device 80 having a 58 micrometer orifice in its center where the drops emerge. The side by side portions represent different points in time. Relative size can be appreciated from the fact that the distance "d" in each figure is approximately ½ mm. Because the drop frequency is equal to the pulse frequency of around 200–250 Hz, a strobe light and a magnified videocam is used to view the drop formation and the meniscus in the lower center of the jetting device 80. Except for the drops which will be mentioned, there may be smaller spots which are actually artifacts and not actually drops of material.

Figure 5:
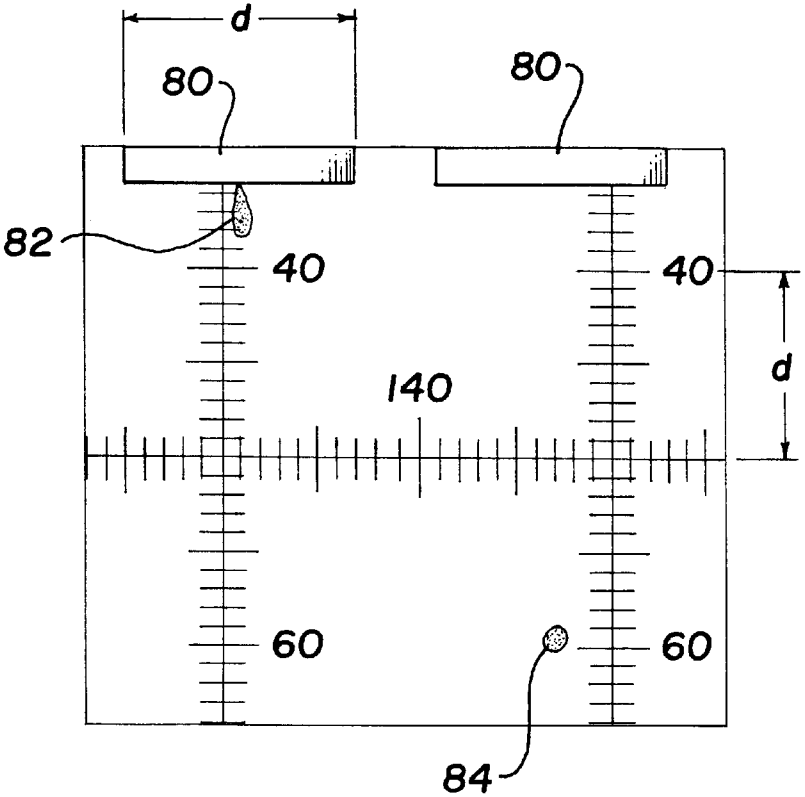
Fig. 5 PRIOR ART
FIG. 5 is a representation showing actual drop ejection of a solder composition from a jetting device of the type shown FIG. 2 as produced using the waveform of FIG. 3. It is shown as formed, and at a slightly later time after the drop is spheroidized in an inert atmosphere below the device.

FIG. 5 shows solder jetting using the conventional waveform with short transition times as in FIG. 3. The left side of FIG. 5 shows a solder drop 82 which is just formed and leaving the orifice. The right side of FIG. 5 shows another solder drop 84 from the same device after it has traveled some distance while liquid. It is drawn into a spherical shape in the inert atmosphere under device 80 by surface tension effects.

Figure 6:
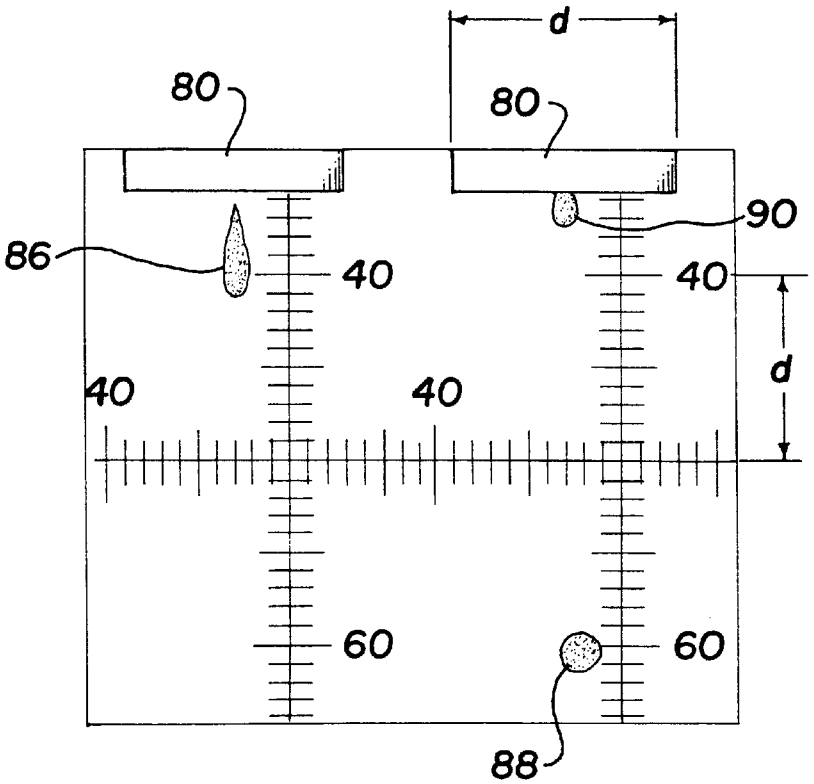
FIG. 6 is a representation showing actual drop ejection of the solder composition from the same jetting device as FIG. 5 as produced using the improved waveform of FIG. 4. It is shown as it is formed, and at a slightly later time after the drop is spheroidized in an inert atmosphere below the device. The drop of FIG. 6 is roughly twice the diameter and eight times the volume of the drop of FIG. 5.

FIG. 6 shows the same device 80 operating in demand mode with the extended transition waveform like that of FIG. 4. A solder drop 86 is seen just leaving the orifice of jetting device 80. The right hand side of FIG. 6 shows a sister drop 88 after surface tension has drawn it into a spherical shape further away from jetting device 80. It can be seen that spherical drop 88 is approximately twice the diameter of drop 84. Significantly, since the volume of a sphere is proportional to the cube of the diameter, drop 88 can be seen having a volume eight times the volume of drop 84. This is a significant increase not heretofore possible by other known means.

The right hand side of FIG. 6 also shows an excursion 90 from the meniscus of the orifice of device 80 which oscillates back and forth across the opening in preparation for drop formation. The meniscus can be seen with the videocam/strobe light setup. This makes it possible to adjust the parameters of voltage, transition time and dwell times experimentally in order to optimize drop production. By strobing successive drops in one frame and measuring the distance between two drops it is possible to calculate the drop velocity as the product of drop frequency and the distance between successive drops. As drop size increases the device becomes more inefficient and drop velocity decreases. As indicated in FIG. 7 it is necessary to increase the voltage to compensate for that decrease. Energy input to the device by the piezoelectric crystal is always manifested by the drop velocity such that optimal or maximum energy input can be determined by optimal or maximum drop velocity. These changes can be visually observed in the manner indicated in order to obtain the desired large diameter drops. Although the phenomena is very complex and not completely understood it is believed that by putting energy in over a long period of time relative to the acoustic frequency of the jetting device, the acoustic waves in the fluid are bouncing back and forth several times within the jetting device up to about three oscillations or more. Then as the device is held at the first rest voltage there may be another three sets of oscillations which seems to produce a net movement of the fluid to build a bigger and bigger meniscus that then breaks off and that's the mechanism that gives the bigger drops. For example, if the resonant period is 40 microseconds, conventionally the transition time would be made much less that 40 microseconds i.e., less than 12% of that. Conventional rapid energy input over a short transition period causes the meniscus at the orifice to oscillate but without any bulk motion of the fluid. With the procedure of the present invention utilized to get larger drops transition times are defined that are a multiple of that 40 microseconds. At least three times that 40 microseconds has been used for the transition time. That appears to allow an asymmetry in the flow to move the bulk of the fluid towards the orifice over those multiple cycles. The initial transition time and the second transition time are defined as multiples of the acoustic period in order to create that net fluid motion or bulk motion on top of the oscillation.

The delay time between the two, namely the first dwell time, is selected as a multiple of the acoustic period which for reenforcement purposes may be one half, one and a half or three times the acoustic period and the second delay period is selected as an integer multiple of the first delay period such as one, two, three, four or five times the acoustic period. Increasing the first delay period tends to increase the drop size with appropriate adjustments of the voltage to maintain the velocity but the main benefit is reached by means of the extended transition time whereby the energy is applied much more slowly than it is done in the conventional inkjet waveform as in FIG. 3. The second delay is not nearly as important as the first delay period. The second delay and final rise in voltage serve mainly to cancel the residual acoustic waves in preparation for the next pulse. For a given system having the characteristics of FIG. 7, it is possible to select in real time a transition time and voltage to produce droplets of a given size. In other words, the first delay is timed to reinforce the energy associated with the first and second transitions. The second delay period is chosen to deconstructively reinforce or dampen the energy in the system to get ready for the next wave pulse.

Figure 8:
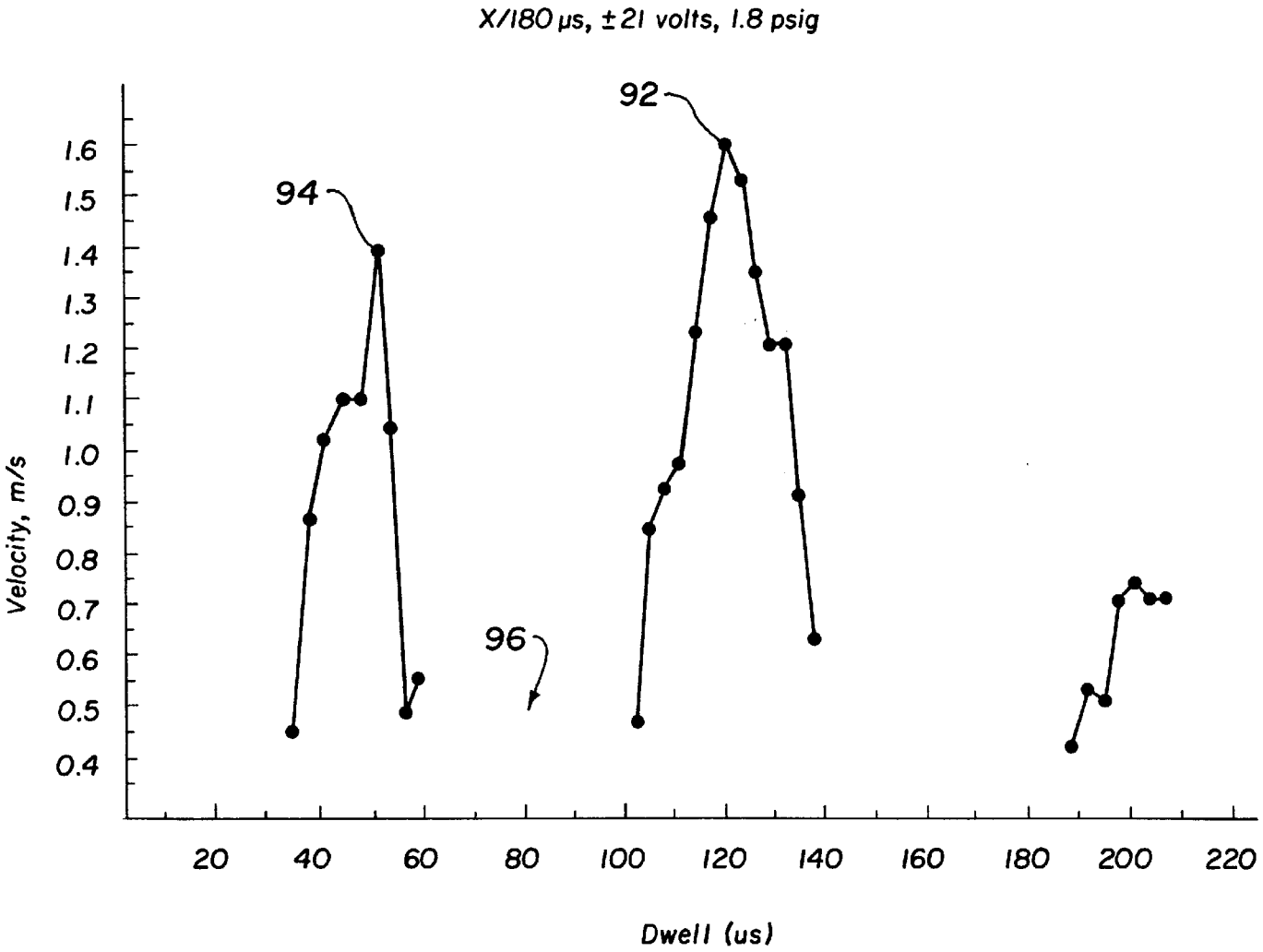
FIG. 8 illustrates the effect of variable first (primary) and fixed second (echo) dwell times with a known waveform on drop velocity at constant voltage in jetting a solder composition from a device like that of FIGS. 5 and 6 having about a 58 $\mu$m orifice. The ungraphed portions represent a failure to jet.
Figure 9:
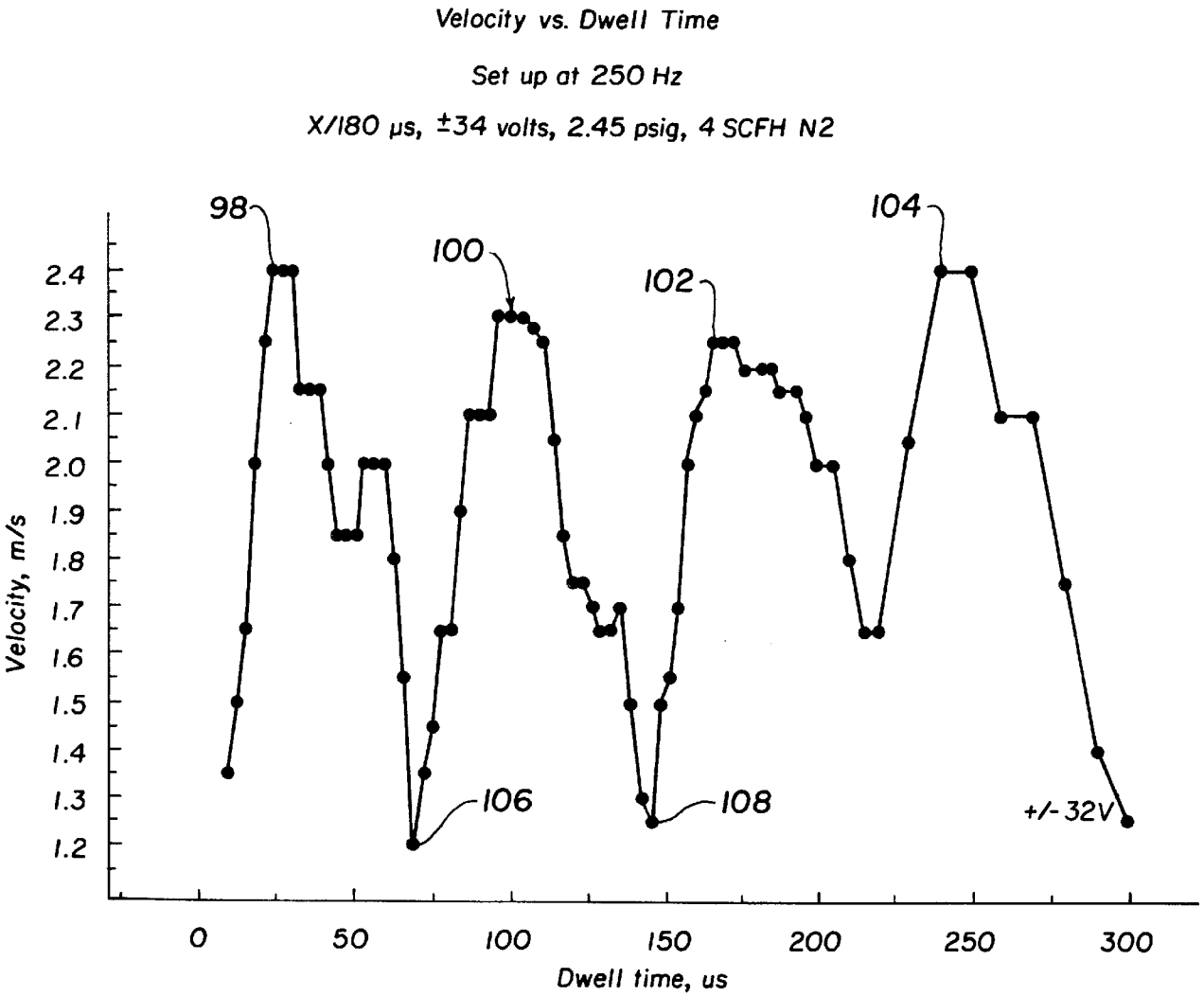
FIG. 9 is a graph under the circumstances of FIG. 8 at a somewhat higher waveform voltage from about a 54 $\mu$m orifice showing repeated drop velocity peaks as the first (primary) dwell time (X) is increased. Further experiments using the extended transition time waveform of FIG. 4 show the same multiple peaking phenomena.

The charts of FIGS. 8 and 9 illustrate the effects of the first dwell time in conventional solder jetting with a bipolar waveform and orifice diameters respectively of 58 micrometers and 54 micrometers. A similar effect is seen using the extended transition bipolar waveform of the present invention. The voltage differential is the voltage above and below the base line and the pressure shown is applied to the solder reservoir. The pressure is another variable which can be adjusted to optimize solder jetting. The atmosphere referred to in FIG. 9 is the flow of inert gas delivered to the space below the printhead. In both cases a 180 microsecond second dwell time was chosen. As mentioned, the second dwell time does not have much effect on solder drop size.

FIG. 8 shows how to get a desired drop velocity of about 1.5 to 2 meters per second by selecting various first dwell times which rise to a maximum and then drop off over small ranges of first dwell time. This tends to produce operating peaks because of the reinforcement effect on the acoustic waves in the fluid. It can be seen that the desired efficiency was best obtained at about a first dwell time of 120 microseconds although it was just barely above the desired drop velocity range. In this case the optimum first dwell time was dwell time 92 which would be the best operating range for this system. The second best first dwell time 94 could also be chosen. It is noted that the ungraphed areas between the peaks 92, 94 and beyond represent areas in which jetting actually ceased. In other words, a zero velocity was obtained. Area 96 is such an area.

FIG. 9 shows optimum peaks at first dwell time 98, 100, 102 and 104. Higher velocities within the desired range 1.5 to 2 and beyond were achieved at the higher voltage of plus or minus 34 volts from the base voltage. In this case although drop velocity had peaks similar to those of FIG. 8, and go through a minima between peaks, jetting did not cease at minimum drop velocity such as 106 and 108. For optimum efficiency and consistency in drop formation it would be desirable to operate at one of the maxima 98, 100, 102 or 104 which are not on a steep part of the curve to avoid variations in drop velocity arising from voltage transients. Above all, stable operation is a critically important goal in solder jetting.

Although the present invention has been described with reference to a presently preferred embodiment, it will be appreciated by those skilled in the art that various modifications, alternatives, variations, etc. may be made without departing from the spirit and scope of the invention as defined in the appended claims.

I claim:

1. A method for producing in demand mode a series of drops of a jettable liquid which exceed the diameter of an exit orifice, comprising, providing an operable demand mode jetting device comprising a chamber having an exit orifice in front, an intermediate section including a voltage operated transducer and a jetting fluid supply behind, which define an acoustic fluid chamber having a resonant frequency and acoustic period;

operating the jetting device in demand mode by applying a drive voltage at a selected frequency;

applying said drive voltage by increasing in magnitude the drive voltage from an initial rest voltage to a first rest voltage over a first transition time about equal to or greater than the acoustic period;

holding the drive voltage at the first rest voltage for a first dwell time selected to reinforce the energy input applied to the fluid by the transducer;

returning the drive voltage from the first rest voltage to the initial rest voltage; and whereby a series of individual drops-on-demand of a diameter which substantially exceed the diameter of the exit orifice are produced in response to delayed application of the drive voltage.

2. The method of claim 1 wherein the drive voltage is returned from the first rest voltage to the initial rest voltage over a second transition time having about the same duration as the first transition time.

3. The method of claim 1 wherein the transducer is approximately centered between the orifice in front and an acoustically reflective boundary configuration behind and the first dwell time is selected from the group comprising about one half, one and one half or three times the acoustic period of the jetting device.

4. The method of claim 1 wherein the first transition time is selected from a range of about one times the acoustic period to about three times the acoustic period.

5. The method of claim 4 wherein the drive voltage is returned from the first rest voltage to the initial rest voltage over a second transition time having about the same duration as the first transition time.

6. The method of claim 5 wherein the transducer is approximately centered between the orifice in front and an acoustically reflective boundary configuration behind and the first dwell time is selected from the group comprising about one half, one and one half or three times the acoustic period of the jetting device.

7. The method of claim 2 wherein the exit orifice is about 60 $\mu$m in diameter or less and the parameters of change in drive voltage between the initial and first rest voltages at a selected frequency, the first transition time in excess of the acoustic period and the first dwell time are selected to produce drops-on-demand of at least about 90 $\mu$m in diameter.

8. The method of claim 7 wherein the selected frequency for operation of the device is less than about 1000 Hz.

9. The method of claim 1 wherein the jettable liquid is molten solder.

10. The method of claim 6 wherein the jettable liquid is molten solder.

11. In a method for producing in demand mode a series of drops of jettable fluid solder comprising an operable demand mode solder jetting device having a chamber comprising an elongated body tube with an exit orifice in front and a supply reservoir behind, a voltage operated transducer in communication with said tube connected electrically to a drive control system capable of applying a series of drive voltages to the transducer in a desired pattern of pulses, said pattern comprising raising the drive voltage from a base voltage to a first rest voltage, holding at the first rest voltage for a first dwell time, then dropping the drive voltage to the base voltage or beyond, wherein the jetting device has a characteristic resonant frequency and acoustic period, the improvement comprising:

operating the jetting device in demand mode by applying a series of drive voltage pulses at a selected frequency by raising the drive voltage from the base voltage to the first rest voltage over a first transition time about equal to or greater than the acoustic period;

holding the drive voltage constant for a first dwell time selected to maximize velocity of jetted droplets;

dropping the drive voltage from the first rest voltage to base voltage over a second transition time which is at least half the first transition time; and whereby drops on demand of the jettable fluid solder are produced which substantially exceed the diameter of the exit orifice.

12. The method of claim 11 wherein the step of dropping the drive voltage from the first rest voltage to the base voltage includes the step of dropping the first rest voltage below the base voltage over the second transition time which in total approximates the first transition time.

13. The method of claim 12 wherein the change in drive voltage across the second transition time is about twice the change in drive voltage across the first transition time.

14. The method of claim 13 wherein the drive voltage is dropped across the second transition time to a second rest voltage which is held constant for a second dwell time wherein the second rest voltage is raised to the base voltage over a third transition time selected to dampen energy within the chamber of said jetting device in preparation for a new drive pulse.

15. The method of claim 14 wherein each of the first, second and third transition times are about equal and at least equal to or greater than the acoustic period of the jetting device.

16. The method of claim 15 wherein the selected frequency for operation of the jetting device is less than about 500 Hz.

17. The method of claim 16 wherein said drive voltage is applied over said transition times at a rate of about 1 volt per microsecond.

18. A method for producing in demand mode a series of drops of jettable fluid solder which substantially exceed the diameter of an exit orifice, comprising:

providing an operable demand mode solder jetting device having a chamber comprising an elongated body tube having an exit orifice in front and a supply reservoir behind, a voltage operated transducer in communication with said tube and a drive control system electrically connected to said transducer capable of applying a series of drive voltages to said transducer, said solder jetting device having a characteristic acoustic period;

operating the jetting device in demand mode by applying a series of drive voltage pulses at a selected frequency;

applying each of the drive voltage pulses by increasing in magnitude the drive voltage from an initial rest or base voltage to a first rest voltage over a first transition time which at least equals or exceeds said acoustic period;

holding the drive voltage constant for a first dwell time selected to maximize velocity of jetted solder droplets;

returning the drive voltage from the first rest voltage to a second rest voltage over a second transition time which is about equal to the first transition time; and whereby drops on demand of the jettable fluid solder are produced which substantially exceed the diameter of the exit orifice.

19. The method of claim 18 whereby the first transition time is selected to be at least about twice the acoustic period of the solder jetting device.

20. The method of claim 19 wherein the orifice in front of the solder jetting device is about 75 $\mu$m or less in diameter and the magnitude of the change in drive voltage between the initial and first rest voltages, the first dwell time and the magnitude of the change in drive voltage between the first rest voltage and the second rest voltage are selected and applied to said solder jetting device to produce jetted solder drops having a diameter of at least 1.25 to 2 times the orifice diameter at a velocity within the range of from about 1 meter per second to about 3 meters per second.

21. The method of claim 18 wherein the drive voltage is applied at a rate of about 1 volt per microsecond over the first transition time.

22. In a method of operating a liquid jetting device of the type having a voltage operated transducer in operable combination with an acoustic fluid chamber having an exit orifice and jettable liquid supply, wherein an operating voltage to the transducer has a waveform which comprises an increasing voltage from an initial voltage to a first rest voltage over a first transition time, a first dwell time in which the drive voltage is held at the rest voltage and a decreasing voltage from the rest voltage back to the initial voltage over a second transition time, the improvement comprising:

increasing the first transition time and the second transition time an amount sufficient to produce liquid droplets having a diameter greater than 110 percent of the exit orifice diameter.

23. The method of claim 22 wherein the first and second transition times over which the operating voltage is applied to the transducer is increased in an amount sufficient to produce liquid droplets having a diameter greater than about 125 percent of the exit orifice diameter.

24. The method of claim 22 wherein the first and second transition times over which the operating voltage is applied to the transducer is increased in an amount sufficient to produce liquid droplets having a diameter greater than about 150 percent of the exit orifice diameter.

25. The method of claim 22 wherein the absolute value of the first transition time is at least 40 microseconds.

26. The method of claim 22 wherein the absolute value of the first transition time is at least 60 microseconds.

27. The method of claim 23 wherein the absolute value of the first transition time is at least 40 microseconds.

28. The method of claim 23 wherein the absolute value of the first transition time is at least 60 microseconds.

29. The method of claim 24 wherein the absolute value of the first transition time is at least 40 microseconds.

30. The method of claim 24 wherein the absolute value of the first transition time is at least 60 microseconds.

31. The method of any one of claims 1–8, or 22–30 wherein the jetting device is a solder jetting device and the jetting fluid being worked to produce droplets is molten solder.

* * * * *